US005589257A

United States Patent [19]

Carriker et al.

[11] Patent Number: 5,589,257

[45] Date of Patent: Dec. 31, 1996

[54] LOW PERMEABILITY GEOSYNTHETIC CLAY LINER AND METHOD OF MANUFACTURE THEREOF

[75] Inventors: Richard W. Carriker, Woodstock; John M. Fuller, Dunwoody, both of Ga.

[73] Assignee: Claymax Corporation, Chicago, Ill.

[21] Appl. No.: 436,540

[22] Filed: May 8, 1995

[51] Int. Cl.[6] ..... B32B 19/06

[52] U.S. Cl. ..... 428/284; 428/141; 428/143; 428/152; 428/174; 428/179; 428/182; 428/703; 405/129; 405/258; 405/268; 405/270

[58] Field of Search ..... 428/141, 143, 428/152, 174, 179, 182, 703, 284; 405/129, 258, 268, 270

[56] References Cited

U.S. PATENT DOCUMENTS 5,063,100 11/1991 Alexander ..... 428/137
5,174,231 12/1992 White ..... 112/420
5,346,566 9/1994 White ..... 156/71
5,350,255 9/1994 Carriker ..... 405/270
5,360,294 11/1994 Carriker ..... 405/270
5,403,126 4/1995 Carriker ..... 405/270
5,436,050 7/1995 Carriker ..... 428/87

*Primary Examiner*—Archene Turner
*Attorney, Agent, or Firm*—Marshall, O'Toole, Gerstein, Murray & Borun

[57] ABSTRACT

A geosynthetic clay liner with a low permeability or controlled permeability intermediate sheet is provided. The liner includes two outer sheets with two layers of bentonite and an intermediate sheet disposed therebetween. The intermediate sheet may be rippled or deformed to enhance the structural stability of the liner. The intermediate sheet may be chosen from a material with low or ultra-low permeability characteristics or may be chosen from a material with controlled or directional permeability characteristics.

15 Claims, 2 Drawing Sheets

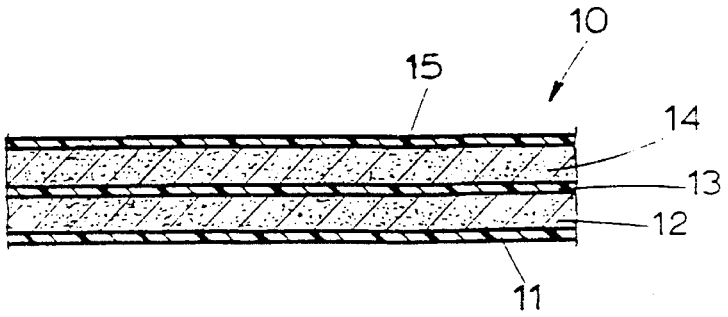
FIG. 1
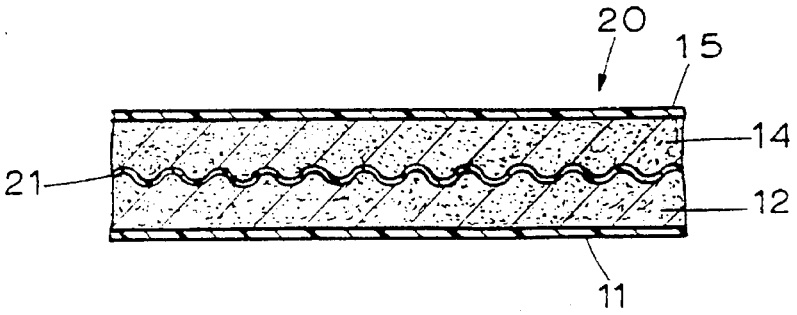
FIG. 2
FIG. 3
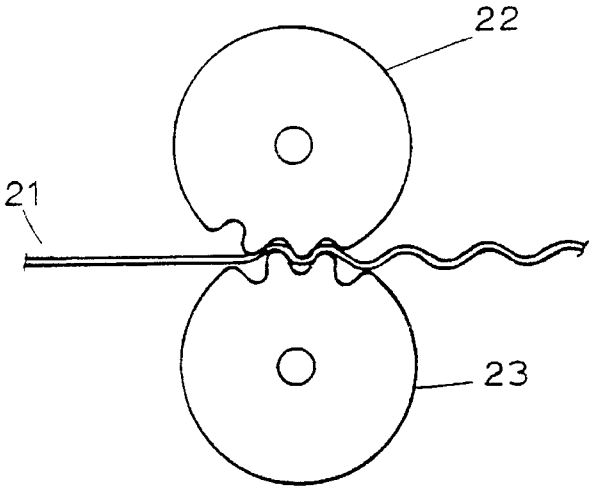

LOW PERMEABILITY GEOSYNTHETIC CLAY LINER AND METHOD OF MANUFACTURE THEREOF

FIELD OF THE INVENTION

This invention relates generally to geosynthetic clay liners for use in creating low permeability bottom layers or barriers in waste containment sites, man-made bodies of water and other applications where a low permeability barrier is required. More specifically, this invention relates to a geosynthetic clay liner with a low or controlled permeability sheet or layer included within the body of the geosynthetic clay liner. Still more specifically, the present invention relates to a geosynthetic clay liner consisting of two textile sheets with at least one layer of bentonite and a low or controlled permeability sheet or layer disposed therebetween.

BACKGROUND OF THE INVENTION

The concept of using geosynthetic clay liners (GCLs) for creating a low permeability layer or barrier for use in landfills and man-made bodies of water is well known. While GCLs made with bentonite provide an effective barrier, users of such GCLs often complain that the GCLs are not effective enough, i.e. the GCLs do not provide sufficiently low permeabilities under certain circumstances, such as landfill caps and deep ponds, because of low confining stresses that can practically be applied to the GCL as a result of soil cover thickness limitations.

For example, many state regulations and project specifications require that the drainage out of a man-made pond be less than 500 gallons per day per acre of pond. This requirement is problematic for deep ponds where the height of the water level is greater than 3 feet. In practice, the drainage out of deep ponds lined with conventional GCLs generally exceeds several thousand gallons per day per acre of pond because current GCLs have permeabilities ranging from $5\times10^{-9}$ cm/sec to $1\times10^{-7}$ cm/sec. Further, typical GCLs are relatively thin having a typical thickness of 0.7".

Therefore, it would be desirable to provide a bentonite GCL with an improved or controlled permeability. The resulting GCL could be an ultra low permeability GCL used to provide an effective barrier against the transmission of liquids (i.e. with permeabilities less than $5\times10^{-10}$ cm/sec).

BRIEF DESCRIPTION OF THE INVENTION

The present invention makes a significant contribution to the geosynthetic clay liner art by providing a liner with improved low permeability characteristics and/or controlled permeability characteristics. Specifically, reviewing the construction of the GCL of the present invention from bottom to top, the GCL includes a primary carrier sheet with a first layer of bentonite disposed on top of the primary carrier sheet. A middle or intermediate layer is disposed on top of the first layer of bentonite and an optional second layer of bentonite is disposed on top of the middle or intermediate layer. Finally, a top cover sheet is disposed on top of the second layer of bentonite.

In the alternative, the middle or intermediate layer may be disposed adjacent to the cover sheet or with only a single layer of bentonite disposed between the intermediate layer and the primary carrier sheet. Also, the intermediate layer may be disposed adjacent to the primary carrier sheet with only a single layer of bentonite disposed between the intermediate layer and the cover sheet.

The intermediate layer can provide both improved low permeability characteristics and controlled permeability characteristics. Specifically, if the intermediate layer is in the form of a sheet, the intermediate sheet may be fabricated from a plastic material that will not permit the migration of any substantial amounts of liquid. Alternatively, the intermediate sheet may be fabricated from a plastic that will permit the migration of small, controlled amounts of liquid.

The intermediate layer may also be provided in the form of a coating of polymer to the first bentonite layer. Again, an optional second bentonite layer may be disposed on top of the coating of polymer material.

Further, the low permeability characteristics of the present invention may be enhanced by constructing the GCL with a high swelling, low permeability and/or chemically altered bentonite clay.

The structural stability of the GCL of the present invention may also be enhanced by using an intermediate sheet of a corrugated or wave-like configuration. The intermediate layer may also be altered chemically or mechanically in a way to enhance the adherence of the bentonite to the intermediate layer. If the intermediate layer is in the form of a polymer that is sprayed on or otherwise applied to the first layer of bentonite, the polymer may be chosen so it attains a relatively rigid structure after it dries so it can contribute to the structural stability of the GCL as well.

It will be noted that the bottom sheet that engages the ground is generally known as the primary carrier sheet and that the top sheet on which landfill material is deposited is generally known as the cover sheet. However, it will also be noted that the primary carrier sheet and cover sheet may be made of identical fabric thereby enabling either the top or bottom sheet to face downward. In any event, this invention is not limited to a specific primary carrier sheet material or any specific top cover sheet material.

The present invention also lends itself to an improved method of manufacturing an improved GCL which comprises the following steps. The first layer of bentonite is disposed on top of either a primary carrier sheet or cover sheet. An intermediate layer is disposed on top of the first layer of bentonite. An optional second layer of bentonite is disposed on top of the intermediate layer before either the cover sheet or the primary carrier sheet is disposed on top of the second layer of bentonite to complete the sandwich-type construction of the GCL. Then, the GCL can be held together in a variety of methods including gluing, sewing or needle-punching. Glue can be applied to the inside-facing surfaces of the primary and cover sheets as well as the intermediate sheet or layer during construction. Glue may also be applied to the layers of bentonite. If the primary and cover sheets are made of non-woven materials, the GCL may be needle punched together. Finally, the edges may be sewn or the entire GCL may be sewn together in a "quilt-like" fashion.

It is therefore an object of the present invention to provide a GCL with improved low permeability characteristics.

Yet another object of the present invention is to provide a GCL with controlled permeability characteristics.

It is still another object of the present invention to provide an improved method of manufacturing GCLs.

Other objects and advantages of the present invention will become apparent upon reading the following detailed description of the drawings and appended claims, and upon reference to the accompanying drawings.

BRIEF DESCRIPTION OF THE DRAWINGS

The invention is illustrated more or less diagrammatically in the accompanying drawings wherein:

FIG. 1 is a sectional view of a geosynthetic clay liner made in accordance with the present invention;

FIG. 2 is a sectional view of another geosynthetic clay liner made in accordance with the present invention;

FIG. 3 is a schematic illustration of one method of fabricating a deformed intermediate sheet to be used in geosynthetic clay liners made in accordance with the present invention;

Figure 4:
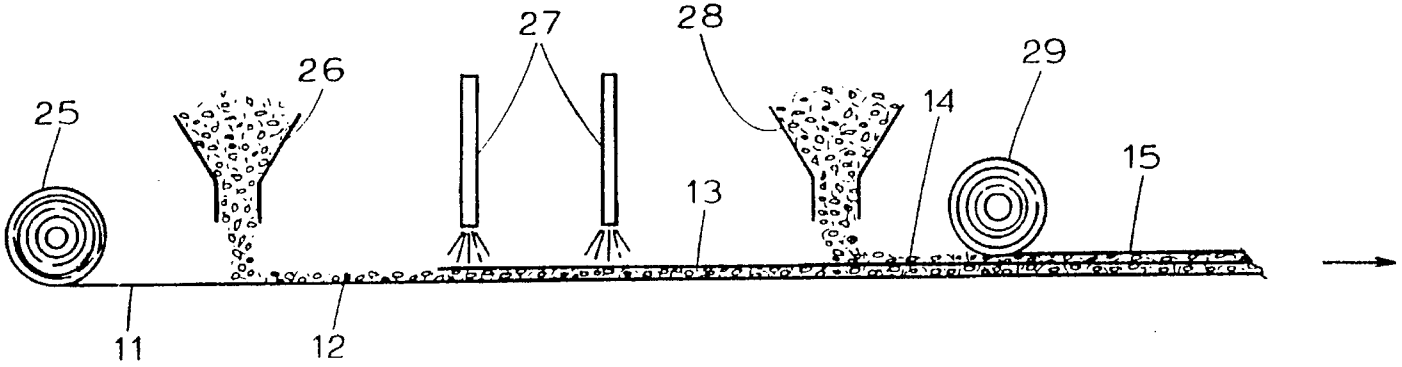
FIG. 4 is a schematic illustration of one method of manufacturing a geosynthetic clay liner in accordance with the present invention.

It should be understood that the drawings are not necessarily to scale and that the embodiments are sometimes illustrated by diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE DRAWINGS

Like reference numerals will be used to refer to like or similar parts from Figure to Figure in the following description of the drawings.

A sectional view of a GCL made in accordance with the present invention is illustrated in FIG. 1. Specifically, the GCL 10 of the present invention includes a primary carrier sheet 11, a first layer 12 of bentonite, preferably in granular form, an intermediate sheet or layer 13, a second layer 14 of bentonite, again preferably in granular form, and a cover sheet 15. Again, it will be noted that the cover sheet 15 and primary carrier sheet 11 may very well be interchangeable. The intermediate layer or sheet 13 as shown in FIG. 1 has the ability to dramatically decrease the effective permeability of the GCL 10. In effect, the GCL 10 as shown in FIG. 1 can be an ultra low permeability GCL if the intermediate sheet or layer 13 is fabricated from a ultra low permeability material, such as many plastics that are known in the art. The intermediate layer 13 may also be altered chemically or mechanically to enhance the adherence of the bentonite layers 12, 14 to the intermediate layer 13.

The intermediate sheet or layer 13 may be applied in two ways. First, if the intermediate sheet 13 is indeed in sheet form, the sheet may be simply disposed on top of the first layer of bentonite as shown below in FIG. 5. However, if the intermediate layer 13 is a layer of polymer material which is sprayed or otherwise applied in liquid or molten form onto the first bentonite layer 12, the intermediate layer 13 is then applied in accordance with the process shown in FIG. 4.

An additional improvement is illustrated by the GCL 20 shown in FIG. 2. Again, the GCL 20 includes a carrier sheet 11, a first layer of bentonite 12, a second layer of bentonite 14 and cover sheet 15. However, the GCL 20 includes a rippled or corrugated intermediate sheet or layer 21 which enhances the structural stability of the GCL 20 because the bentonite layers 12, 14 become very slippery when exposed to water. By providing an intermediate sheet or layer 21 with ripples, corrugations or other alterations which may be mechanical or chemical in nature, a higher frictional surface may be provided to deter or retard slippage between the bentonite clay layers 12, 14 and the intermediate sheet 21. Chemical or mechanical alterations of the intermediate layer 21 may be used to enhance the adherence of the bentonite layers 12, 14 to the intermediate layers 21. The result is a GCL 20 with the improved permeability characteristics discussed above with respect to the GCL 10 and also with an improved structural stability.

In addition, specific grades or types of bentonite may be selected to enhance the low permeability characteristics of the GCLs 10, 20. A high swelling, low permeability or chemically altered bentonite clay may be selected. One particularly preferable type of clay is western bentonite. The layers of bentonite 12, 14 are applied in amounts approximating one-half pound per square foot but do not have to be applied in equal amounts. Amounts in each layer may vary between zero and 2 pounds per square foot.

Typically, a GCL without an intermediate sheet 13 or 21 will have an overall effective permeability from $1\times10^{-7}$ cm/sec to $5\times10^{-9}$ cm/sec, depending on the confining stress applied to the GCL. The incorporation of an intermediate sheet or layer such as 13, 21 will provide a GCL with an effective permeability of approximately $5\times10^{-11}$ cm/sec at low confining stresses, thereby providing a substantial improvement.

The intermediate sheets may be fabricated from polyvinylchloride, polyethylene, polypropylene, nylon or other polymeric compounds. Such materials normally weight between 0.5 to 25 ounces per square yard.

If a controlled permeability is desired, other sheet or fabric materials that offer combinations of controlled or directional permeability may be considered for the intermediate sheets or layers 13, 21. Such materials include battery separator fabrics, fabrics used in disposable diapers and protective clothing.

FIG. 3 is an illustration of One method of providing a corrugated or rippled intermediate sheet 21. The sheet 21 is fed between an upper 22 and lower 23 embossing roller to provide the ripple or corrugated effect.

Figure 5:
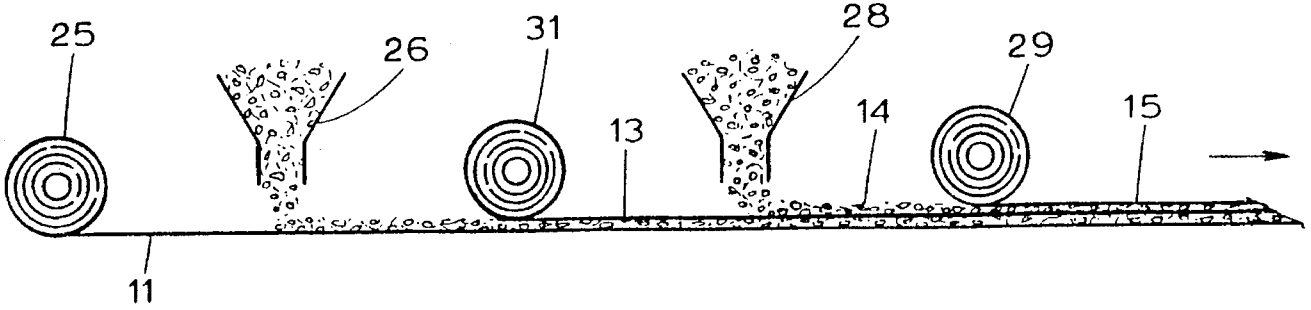
FIG. 5 is a schematic illustration of another method of fabricating a geosynthetic clay liner in accordance with the present invention.

Improved methods of manufacturing low or controlled permeability GCLs is illustrated in FIGS. 4 and 5. Briefly, the carrier sheet 11 is unrolled from the roll 25. The first layer of bentonite 12 is deposited on the carrier 11 as it passes under the hopper 26. The intermediate layer 13 may be applied via one or more spray nozzles or other methods of applying a liquid or molten material shown generally at 27 before the second layer of bentonite 14 is deposited on top of the intermediate layer 13 as the partially-fabricated GCL passes under the hopper 28. Finally, the top carrier 15 is deposited on top of the second layer of bentonite 14 as the GCL passes underneath the roll 29.

The method illustrated in FIG. 5 employs the same steps except that the intermediate sheet 13 is provided by the roll 31 as opposed to the nozzles 27 as shown in FIG. 4.

Although only two embodiments of the present invention have been illustrated and described, it will at once be apparent to those skilled in the art that variations may be made within the spirit and scope of the invention. Accordingly, it is intended that the scope of the invention be limited solely by the scope of the hereafter appended claims and not by any specific wording in the foregoing description.

What is claimed is:

1. An improved flexible geosynthetic clay liner having a water permeability less than $5\times10^{-10}$ cm/sec comprising:

a primary carrier sheet of fabric;

a first layer of bentonite disposed on top of the primary carrier sheet;

an intermediate polymeric sheet or fabric layer disposed on top of the first layer of bentonite;

a second layer of bentonite disposed on top of the intermediate layer; and a cover sheet of fabric disposed on top of the second layer of bentonite.

2. The geosynthetic clay liner of claim 1, wherein the intermediate layer is fabricated from a sheet of low permeability plastic.

3. The geosynthetic clay liner of claim 1, wherein the intermediate layer is fabricated from a liquid polymer spray.

4. The geosynthetic clay liner of claim 2, wherein the intermediate layer is further characterized as having an undulating lower surface and an undulating upper surface, the undulating lower surface engages the first layer of bentonite and the undulating upper surface engages the second layer of bentonite.

5. The geosynthetic clay liner of claim 1, wherein the intermediate layer is further characterized as being a controlled permeability sheet.

6. The geosynthetic clay liner of claim 1, wherein adhesive is applied to an upper surface of the primary carrier sheet to assist in adhering the first layer of bentonite against the upper surface of the primary carrier sheet and adhesive is applied to a lower surface of the cover sheet to assist in adhering the second layer of bentonite against the lower surface of the carrier sheet.

7. The geosynthetic clay liner of claim 6, wherein adhesive is applied to the upper and lower surfaces of the intermediate layer to assist in adhering the first and second layers of bentonite and the upper and lower surfaces of the intermediate layer respectively.

8. The geosynthetic clay liner of claim 1, wherein the cover sheet, the intermediate layer and the primary carrier sheet are needlepunched together with the first layer of bentonite disposed between the intermediate layer and the primary carrier sheet and the second layer of bentonite is disposed between the intermediate layer and the cover sheet.

9. The geosynthetic clay liner of claim 1, wherein the cover sheet, the intermediate layer and the primary carrier sheet are sewn together with the first layer of bentonite disposed between the intermediate layer and the primary carrier sheet and the second layer of bentonite is disposed between the intermediate layer and the cover sheet.

10. The geosynthetic clay liner of claim 1, wherein the first and second layers of bentonite include chemically altered bentonite to enhance the low permeability characteristics of the liner.

11. The geosynthetic clay liner of claim 1, wherein an undersurface of the primary carrier sheet has a high-friction surface to enhance frictional engagement between the lower surface of the primary carrier sheet and a sloping surface on which the liner is installed.

12. The geosynthetic clay liner of claim 1, wherein the first layer of bentonite is further characterized as having from about 0.25 pounds to about 2 pounds of bentonite per square foot.

13. The geosynthetic clay liner of claim 1, wherein the second layer of bentonite is further characterized as having from about 0.25 pounds to about 2 pounds of bentonite per square foot.

14. An improved flexible geosynthetic clay liner having a water permeability less than $5\times10^{-10}$ cm/sec comprising:

a primary carrier sheet of fabric;

an intermediate polymeric sheet or fabric layer disposed on top of the primary carrier sheet;

a layer of bentonite disposed on top of the intermediate layer; and a fabric cover sheet disposed on top of the layer of bentonite.

15. An improved geosynthetic clay liner comprising:

a primary fabric carrier sheet;

a layer of bentonite disposed on top of the primary carrier sheet;

an intermediate polymeric sheet or fabric layer disposed on top of the first layer of bentonite; and a fabric cover sheet disposed on top of the intermediate layer.

* * * * *